United States Patent [19]

Utt

[11] 4,242,012

[45] Dec. 30, 1980

[54] METHOD FOR CONSTRUCTING A MULTISEASON ICE PLATFORM

[75] Inventor: Michael E. Utt, Placentia, Calif.

[73] Assignee: Union Oil Company of California, Brea, Calif.

[21] Appl. No.: 20,614

[22] Filed: Mar. 14, 1979

[51] Int. Cl.[2] ..... E02B 3/00; E02D 29/02; F25C 1/02

[52] U.S. Cl. ..... 405/217; 405/14; 405/130

[58] Field of Search ..... 405/14, 61, 130, 195, 405/211, 217; 62/260

[56] References Cited

U.S. PATENT DOCUMENTS

| | | | |
|---|---|---|---|
| 2,063,514 | 12/1936 | Meem | 405/14 |
| 3,675,429 | 7/1972 | Willman | 405/217 |
| 3,738,114 | 6/1973 | Bishop | 405/217 |
| 3,750,412 | 8/1973 | Fitch et al. | 405/217 |
| 3,849,993 | 11/1974 | Robinson et al. | 405/217 |
| 3,863,456 | 2/1975 | Durning | 405/217 |
| 4,055,052 | 10/1977 | Metge | 405/217 |
| 4,094,149 | 6/1978 | Thompson et al. | 405/217 X |

OTHER PUBLICATIONS

"Design and Construction of a Caisson Retained Island Drilling Platform for the Beaufort Sea," de Jong et al., Paper No. OTC3294 Presented at the Tenth Annual Offshore Technology Conference, May 1978.

*Primary Examiner*—David H. Corbin
*Attorney, Agent, or Firm*—Dean Sandford; Daniel R. Farrell

[57] ABSTRACT

An ice platform suitable for multiseason use is constructed in a cold offshore region by accumulating ice on a portion of a floating natural ice sheet until the ice mass formed thereby becomes grounded on the marine bottom. A rigid wall element is driven through the ice and a preselected distance into the marine bottom so as to form a structural wall surrounding the ice mass. Subsequently an insulation jacket is installed over the top surface of the ice mass and between the ice mass and the wall. To dismantle the ice platform, the wall and at least part of the insulation jacket are removed to allow natural forces to restore the region to its natural state.

15 Claims, 7 Drawing Figures

METHOD FOR CONSTRUCTING A MULTISEASON ICE PLATFORM

BACKGROUND OF THE INVENTION

1. Field of the Invention

This invention relates to marine bottom-supported structures useful as working platforms in cold offshore regions and more particularly to a method for constructing a grounded ice platform useful in offshore drilling and production operations.

2. Description of the Prior Art

In the continuing search for new petroleum and natural gas reservoirs, considerable interest has recently been focused on exploration and production activities in the arctic and antarctic regions of the world. In these regions, subterranean formations having a potential for petroleum and/or natural gas accumulations are sometimes found underlying ice-covered offshore locations which have relatively shallow waters. Conventional floating and bottom-supported platforms are not well suited for use in these waters.

Various types of bottom-supported platforms have been proposed for use in these regions, including platforms built with steel, concrete and/or fill material dredged from the marine bottom. While these platforms could be designed to be stable and suitable for multiseason use, such platforms are very expensive. In addition to the substantial cost of the materials employed to build such platforms, the cost of transporting these materials to the offshore location and the very high cost of construction at these locations often effectively precludes the use of such platforms. In addition, environmental considerations may necessitate the dismantling of the working platform and restoration of the offshore location to its natural state after operations on the platform are terminated. The cost of dismantling these platforms and restoration of the offshore location may exceed the cost of building the platforms. All of the aforementioned factors weigh heavily against the use of such a platform especially where the platform will only be used for a relatively short time, such as five years or less.

U.S. Pat. Nos. 4,048,808 to Duthweiler, 3,863,456 to Durning and 3,849,993 to Robinson and Durning disclose methods for building grounded ice islands in cold offshore regions. While grounded ice islands are considered suitable as a temporary, single-season working platform for exploratory drilling, the ice islands normally melt and/or break up during the warmer summer months each year. While the cost of constructing a grounded ice island is substantially less than a comparable steel and/or landfill platform, the short useful life of the known ice islands precludes the multiseason use thereof.

Various combinations of ice and steel or other construction materials have been proposed for use in constructing working platforms, such as disclosed in U.S. Pat. Nos. 4,055,052 to Metge, 3,750,412 to Fitch et al. and 3,738,114 to Bishop. However, the methods of construction disclosed therein are not as well suited to operations in cold offshore regions as the method of this invention. Some of these known construction methods require the use of heavy machinery, such as pile drivers, ditching machines, and/or dredging machines, at the offshore location but fail to provide a suitably stable platform upon which such machinery may be supported. Another problem with these known methods arises where ice and a structural steel member, such as the pilings of Fitch et al. and the outer structural wall of Bishop, are expected to freely slide one past the other for a prolonged period during the construction operations. This extended stress tends to weaken the steel member. Yet another problem with these methods is the fact that any ice movement which occurs at the site during the construction operation but before completion of the platform could result in major damage to the partially constructed platform and any other equipment located at the site. Additionally the construction methods disclosed by Bishop and Metge render it difficult to quickly dismantle the ice platform after operations thereon have been completed in order to restore the offshore location to its natural state. Thus a need exists for an improved method for constructing a low cost, multiseason working platform at an offshore location.

Accordingly, it is a primary object of this invention to provide an improved method for constructing a multiseason working platform in a cold offshore region.

Another object of this invention is to provide a method for constructing a multiseason working platform in which a stable base is established upon which any heavy machinery required in the construction method may be supported.

Yet another object of this invention is to provide a construction method in which the materials of construction are not submitted to continuous stress caused by a prolonged sliding movement imposed between dissimilar materials of construction.

A further object of this invention is to provide a construction method during which the integrity of the partially completed ice platform is relatively unaffected by local ice movements during the construction period.

Still another object of this invention is to provide a method for constructing a multiseason ice platform which may be dismantled relatively easily and quickly upon completion of the operations thereon.

Still further object, advantages and features of the invention will become apparent to those skilled in the art from the following description taken in conjunction with the accompanying drawings.

SUMMARY OF THE INVENTION

Briefly, the invention provides an improved method for constructing a multiseason ice platform at a cold offshore location having a sheet of ice floating on a water body. In the method, ice is accumulated on a selected portion of the ice sheet until the ice mass formed thereby becomes grounded on the marine bottom. Thereafter the grounded ice mass is used as a stable platform from which to drive a rigid wall element through the ice to form a structural wall around the perimeter of the grounded ice mass. The wall element is driven a preselected distance into the marine bottom. Subsequently an insulation jacket is installed over the top surface of the ice mass and in an annular space between the structural wall and the ice mass.

The ice platform produced by the method of the invention includes a central ice mass surrounded on the top and sides by the insulation jacket, and a rigid wall surrounding and protecting the sides of the insulated ice mass. In one embodiment of this invention, the weight of the central ice mass is selected to be less than the weight required to resist lateral movement due to the peak lateral displacement forces anticipated during the useful life of the ice platform, and the rigid wall element is driven into the marine bottom a distance which is selected to provide the required additional resistance to such lateral displacement. In this manner, smaller diameter and therefore less expensive ice platforms may be employed in offshore regions in which relatively large displacement forces are expected.

The method of this invention provides a relatively fast and inexpensive method for constructing a multiseason ice platform in which the requirement for heavy machinery does not arise until a stable support base has been established. The cost of the materials of construction and the transportation cost of such materials to the offshore site are reduced to a practical minimum by the method of this invention due to the use of ice as the major building material. The method of this invention is especially well suited to the extremely harsh working environment of the cold offshore regions in which such platforms are to be built. The method of this invention produces an ice platform which is relatively stable and relatively resistant to damage from ice movement throughout the construction operation. Additionally the ice platform produced by the method of this invention is relatively easily dismantled by removing the wall element and at least a portion of the insulation jacket. Thereafter, the natural forces of sun, wind and water restore the site to its natural state.

BRIEF DESCRIPTION OF THE DRAWINGS

The invention will be more readily understood by reference to the drawings, wherein like numerals refer to like elements, in which.

DETAILED DESCRIPTION OF THE INVENTION

Figure 1:
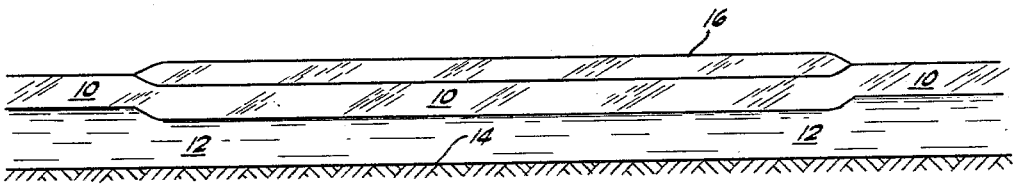
FIGS. 1 through 4 are vertical cross-sectional views of a natural ice sheet and a formed ice mass at an offshore location illustrating successive intermediate stages in the construction method of this invention.

Referring to FIG. 1, natural ice sheet 10 floats on a body of water 12 over marine bottom 14 at the desired offshore location. The depth of water body 12 may range from a few feet to 30 feet or more, with a typical water depth being about 15 feet. Natural ice sheet 10 may range from about 2 feet to about 6 feet or more in thickness, depending upon the location and the time of the year, and it may be part of a polar ice pack or may be "fast ice" which is normally attached to a nearby land mass. Alternatively, natural ice sheet 10 may be a floating ice body or a cutout portion of a larger ice body which has been towed to the desired offshore location.

Figure 2:
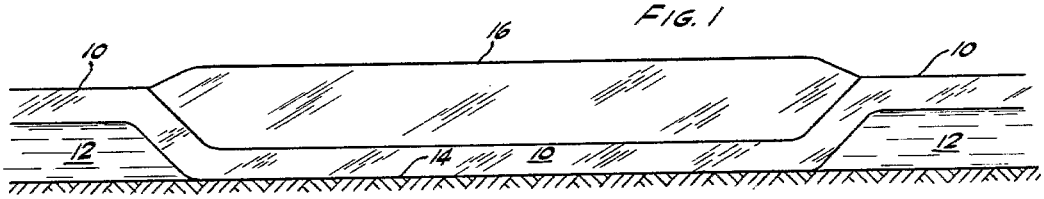

FIGS. 1 through 4 schematically illustrate various stages in the construction method of this invention. As shown in FIGS. 1 and 2, the initial step of the method of this invention involves the accumulation of ice on a selected portion of native ice sheet to thereby form ice mass 16 which eventually grounds the underlying portion of natural ice sheet 10. Methods for accumulating ice to form ice mass 16 are known, such as by distributing water over the surface of ice sheet 10 either by free flooding or confined flooding. The water may be pumped onto the selected portion of ice sheet 10 by pumps supported on the ice within the perimeter of newly formed ice mass 16 or pumps supported on ice sheet 10 outside the perimeter of ice mass 16. Preferably, water is distributed onto the underlying ice in relatively thin, uniform layers, such as from 1 to 5 inches in thickness, and each layer is allowed to freeze before the next layer is deposited thereon. The water may be sprayed or otherwise distributed onto the underlying ice from a water distribution system, such as a fixed sprinkler system or a center-pivot sprinkler system. in any event, ice is accumulated at least until the weight of ice mass 16 deforms ice sheet 10 and grounds the underlying portion of ice sheet 10 to become firmly grounded on marine bottom 14 as shown in FIG. 2. Preferably additional ice is accumulated to build up ice mass 16 to have a freeboard of between about 3 and about 15 feet above the normal level of ice sheet 10.

Figure 3:
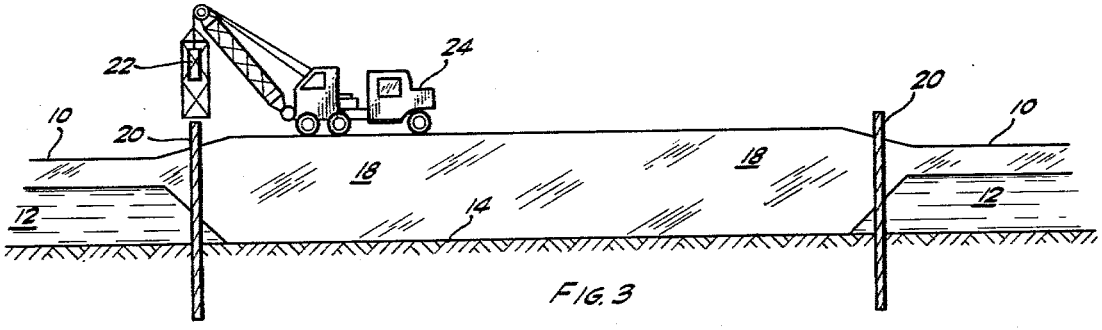
Figure 4:
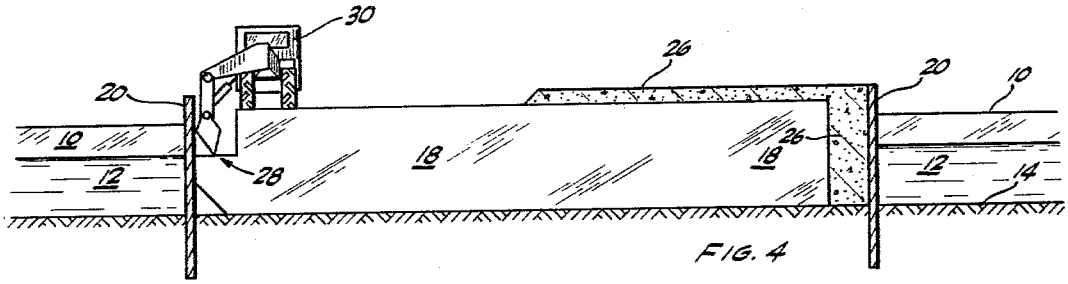

Referring to FIGS. 3 and 4, grounded ice mass 18, which is comprised of ice mass 16 and the underlying portion of ice sheet 10, serves as a stable base from which the subsequent steps of the method of this invention are conducted. As schematically illustrated in FIG. 3, a rigid wall element 20 is driven through the ice around the perimeter of ice mass 18 and is driven a preselected distance into marine bottom 14. The heavy machinery required to support and drive wall element 20, shown in FIG. 3 as pile driver 22 supported from truck 24, is transported to grounded ice mass 18. Whereas the thickness of ice sheet 10 may be sufficient to allow passage thereover of truck 24, it is generally not sufficient to support truck 24 during the installation of wall element 20. The repeated pounding of pile driver 22 and the penetration of the ice by wall element 20 could easily weaken the ice sheet sufficiently to allow truck 24 to break through ice sheet 10 if the machinery were supported thereon instead of being supported on grounded ice mass 18.

Wall element 20 can be any structural wall element capable of being driven through the ice into marine bottom 14 and which, once driven, provides support and protection for grounded ice mass 18. Structural steel walls are preferred due to their high strength per unit weight, and walls constructed from interlocking sheet pile segments are particularly preferred. It is contemplated that a single wall element surrounding ice mass 18 could be driven to form wall element 20, however, as a practical matter a plurality of interconnecting wall segments will be driven consecutively around the perimeter of ice mass 18 to completely surround ice mass 18.

Figure 7:
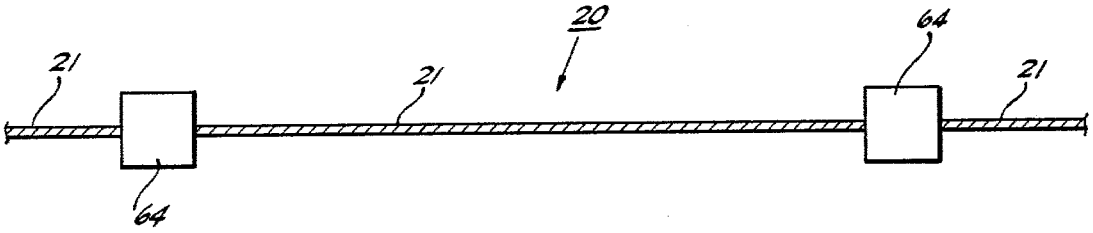
FIG. 7 is a partial plan view of a plurality of interlocking wall segments used to form a rigid wall element in the method of this invention.

FIG. 7 illustrates a plurality of wall segments 21 interconnected by conventional interlocking devices, shown as boxes 64, so as to form wall element 20. The plan view shape of ice mass 18 and wall element 20 is a matter of choice. A cylindrical ice mass and a cylindrical wall element with a circular plan view shape are preferred in offshore regions where the lateral forces expected to be exerted on the ice platform are randomly directed. On the other hand, the plan view shape of the ice platform is preferably a long, narrow ellipse or rectangle in those offshore locations where the lateral forces are expected to be directed predominantly along a single line, such as a line running from north to south through the site. The elliptical- or rectangular-shaped ice platform is preferably constructed such that its length is aligned with the predominant force line and only its relatively narrow width is perpendicular to the predominant force line, thereby reducing the effective cross-sectional area of the ice platform upon which the predominant lateral displacement forces will act.

As schematically illustrated in FIG. 4, insulation jacket 26 is installed on the top of ice mass 18 and between ice mass 18 and wall 20. In the preferred embodiment illustrated, ditch 28 is dug between wall 20 and ice mass 18 by ditching machine 30 which is supported on the top surface of ice mass 18, and fill material, such as gravel or the like from a nearby site, is dumped into ditch 28 and spread so as to form an insulation layer over the top surface of ice mass 18. Other insulating materials, such as foamed insulation, and/or a reflective sheet may be spread over the top surface of ice mass 18. Insulation jacket 26 and wall 20 serve to protect the sides of ice mass 18 from the detrimental thermal and physical action of surrounding water body 12 and ice sheet 10. And insulation jacket 26 serves to protect the top surface of ice mass 18 from the sun, wind and rain. Preferably, the insulating material used to cover the top of ice mass 18 is substantially uniformly distributed over the top of ice mass 18, and the insulating material used to surround the sides of ice mass 18 is substantially uniformly distributed around the sides of ice mass 18. Although typically not required, it is contemplated that refrigeration coils, not shown, can be installed in insulation jacket 26 if required to substantially prohibit melting of ice mass 18.

The thickness of insulation jacket 26 is selected in accordance with the anticipated weather conditions at the offshore location, and the properties of the insulation material itself. Generally the volume of insulation jacket 26 will be relatively small with respect to the volume of ice mass 18. For example, where gravel is employed to form insulation jacket 26, the volumetric ratio of ice mass 18 to insulation jacket 26 is preferably between about 4 and about 200, more preferably between about 10 and about 50. Where more efficient insulating materials, such as lightweight foam insulation, are employed these volumetric ratios will be increased accordingly.

Throughout the construction operation, the ice platform constructed by the method of this invention is relatively stable and relatively resistant to damage by local ice movement. Where natural ice sheet 10 shifts prior to the grounding of ice mass 16, formed ice mass 16 will be displaced as an integral part of ice sheet 10 and suffer little or no damage. Once grounded, the weight of ice mass 18 bearing on marine bottom 14 will resist lateral displacement, and once wall element 20 has been driven through the ice into marine bottom 14 to the preselected depth, no further lateral displacement will occur.

Figure 5:
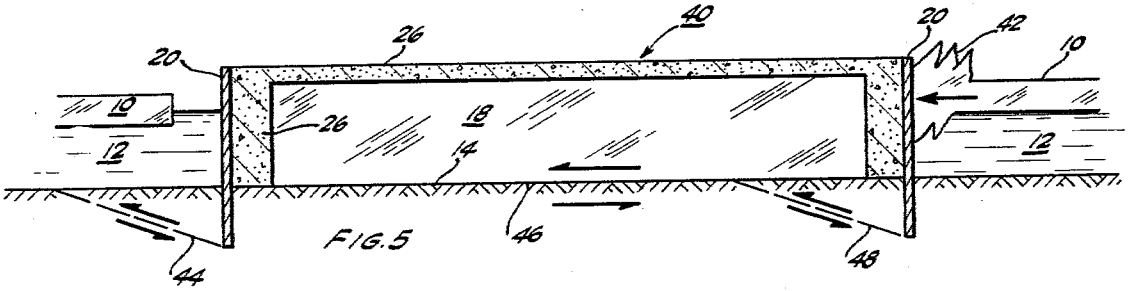
FIGS. 5 and 6 are vertical cross-sectional views of ice platforms constructed in accordance with embodiments of the method of this invention.

FIG. 5 illustrates one embodiment of an ice platform, shown generally as 40, which has been constructed by the method of this invention as illustrated in FIGS. 1 through 4. Ice platform 40 comprises central grounded ice mass 18 which is surrounded on its top and sides by insulation jacket 26, and rigid wall element 20 surrounding and protecting the sides of ice mass 18 and insulation jacket 26.

FIG. 5 also illustrates the manner in which wall element 20 and the weight of ice platform 40 interact to resist lateral displacement forces exerted on ice platform 40 by movement of surrounding ice sheet 10. Peak lateral forces may occur at various times, both during the winter months and during the breakup of ice sheet 10 in the spring or summer. For example, a peak lateral force may occur as a moving ice ridge, such as ice ridge 42, collides with platform 40. The lateral displacement force exerted by ice ridge 42 is counteracted by the static resistance to sliding movement along planar surfaces 44, 46 and 48. The static resistance forces are indicated by the pairs of force arrows along planar surfaces 44, 46 and 48. Planar surface 46 is contact plane between ice mass 18 and marine bottom. If ice platform 40 did not have wall element 20, the resistance to sliding movement along plane 46 would provide the only resistance to the lateral displacement force. However, the presence of wall element 20 effectively increases the weight of ice platform 40 by incorporating the portion of marine bottom 14 in the triangular area above planar surfaces 44 and 48, and also increases the effective surface over which the lateral force is distributed by combining the surface area of planar surfaces 44 and 48 with that of planar surface 46. Accordingly, an ice platform constructed by the method of this invention can be designed, by correlation of the dimensions of ice mass 18 and the depth of penetration by wall element 20 into marine bottom 14, to withstand the expected lateral forces. The stabilizing effect resulting from the use of wall element 20 becomes increasingly significant as the dimensions and hence the weight of ice mass 18 are reduced and the penetration depth of wall element 20 is increased. Preferably wall element 20 penetrates between about 10 and about 100 feet into marine bottom 14, more preferably between about 20 and about 60 feet, with the penetration depth being selected in view of the weight of ice mass 18 to withstand the peak lateral forces expected to be exerted on ice platform 40.

Figure 6:
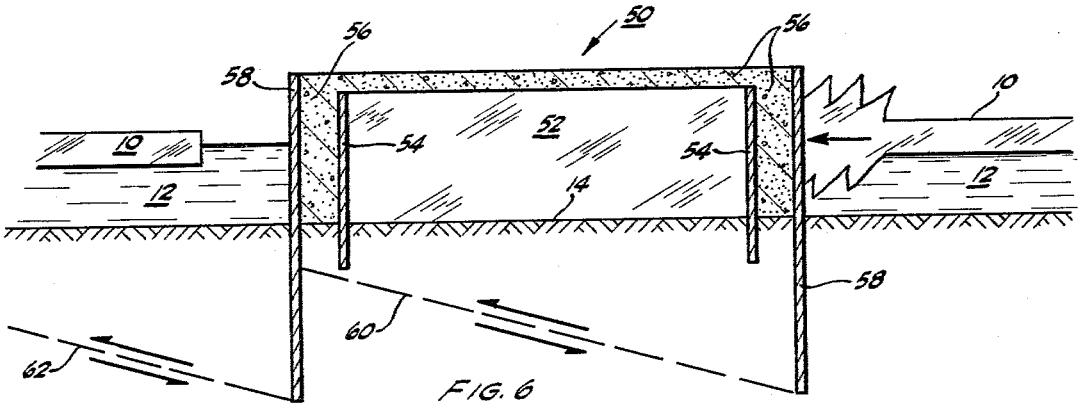

FIG. 6 illustrates another embodiment of an ice platform, shown generally as 50, constructed in accordance with a preferred embodiment of the method of this invention. Ice platform 50 includes (1) central ice mass 52 grounded on marine bottom 14, (2) inner rigid wall element 54 and outer rigid wall element 58 surrounding ice mass 52 and penetrating into marine bottom 14, and (3) insulation jacket 56 comprised of an insulating material disposed in a compartment between wall elements 54 and 58, and disposed in a layer over the top surface of ice mass 52. In the construction of ice platform 50, ice is accumulated on a section of natural ice sheet 10 until the ice mass thus formed becomes grounded on marine bottom 14 and thereafter wall element 58 is driven through the ice surrounding the grounded ice mass and a preselected distance into marine bottom 14, this distance being selected in view of the weight of ice mass 52 to prohibit lateral displacement of ice platform 50. Subsequently, inner wall element 54 and insulation jacket 56 are installed in any order. Preferably inner wall element 54 is installed just before or just after outer wall element 58 has been installed, and the compartment between wall elements 54 and 58 is subsequently dredged out and then filled with insulating material. Inner wall element 54 may also serve to confine water which is later distributed on the grounded ice mass in order to build up the top surface of ice mass 52 to a desired elevation above the normal water level of water body 12. Insulation jacket 26 is then completed by covering the top of ice mass 52 with additional insulating material.

A comparison of FIGS. 5 and 6 demonstrates the variation of the penetration depth for wall elements 20 and 58, respectively, in relation to the weight of ice platforms 40 and 50, respectively, which can be successfully employed in the design of an ice platform in order to construct a stable ice platform by the method of this invention. In FIG. 5, the dimensions of ice mass 18 and insulation jacket 26, and therefore the weight of ice platform 40, are relatively large and the penetration depth of wall element 20 which is required for a stable platform is relatively shallow. By comparison, the dimensions of ice mass 52 and insulation jacket 56 and the weight of ice platform 50 are relatively small, and the penetration depth of wall element 58 is accordingly relatively deep. As a result of this difference in penetration as illustrated in FIG. 6, the sections of marine bottom 14 which become effectively incorporated into ice platform 50 due to the penetration of wall element 58, i.e., the sections of the marine bottom above planar surfaces 60 and 62, is substantially larger than the corresponding sections of marine bottom 14 above planar surfaces 44 and 48 effectively incorporated by wall element 20 into ice platform 40. Thus, the particular dimensions of the ice platform and of the wall element penetration are matters of choice. Preferably the dimensions of the ice platform, i.e. the central ice mass and the insulation jacket, are selected to provide the minimum area on the surface of the ice platform which is expected to be required to conduct the exploration and/or production operation, and the penetration depth of the wall element is selected in view of the weight of the resulting ice platform in order to prohibit lateral displacement of the ice platform.

An important feature of the ice platform of this invention is that the stability of the ice platform will increase over the initial years of its life as a result of the gradual freezing of the portion of the marine bottom directly below the central ice mass. This freezing serves to effectively incorporate the frozen portion of the marine bottom into the ice platform thereby increasing the weight of the ice platform. This aging process is completed in between about one and about five years, and is of course reversible so that the frozen portion of the marine bottom will later be restored to its initial state when the ice platform is dismantled.

The invention is further illustrated by the following example which is illustrative of a specific mode of practicing the invention and is not intended as limiting the scope of the invention as defined by the appended claims.

EXAMPLE

A construction side is located in the Beaufort Sea for the construction of a multiseason ice platform. Water depth at the site is about 15 feet. The marine bottom at the site is dense, fine sand with a submerged unit weight of about 60 pounds per cubic foot. Construction is initiated in the winter when the water body at the construction site is covered with a layer of "fast ice" ranging in thickness between about 1 foot and about 2 feet. This thickness is sufficient to support the construction crew and the equipment required to form a grounded ice mass. Snow is scraped from the ice surface to form a large rectangular area having a length of about 300 feet and a width of about 150 feet. The rectangular area is oriented such that the longer sides thereof are parallel to an east-west line running through the construction site, since the lateral forces of local ice movement and water current have historically acted predominantly along an east-west line through the site.

Ice is accumulated in the rectangular area by distributing water over the area in a plurality of one- to five-inch thick layers, with each layer being allowed to freeze before the next layer is distributed. The ice accumulation is continued until the ice mass formed thereby deforms the natural ice sheet and grounds the rectangular portion of the ice sheet underlying the formed ice mass, to thereby form a grounded ice body.

Thereafter, the heavy machinery required for the subsequent construction steps is transported to the grounded ice body, which serves as a stable working platform for the rest of the construction operation.

Next, a plurality of interlocking sheet pile segments each about 50 feet in height are driven through the ice around the perimeter of the grounded ice body and a preselected distance of about 20 feet into the marine bottom. A trench having a width of about 10 feet is then dug between the sheet pile wall and the grounded ice body, and insulating material comprised of gravel and soil having a density of about 110 pounds per cubic foot is used to fill the trench.

After the grounded ice body has been built up to about 30 feet in height, the top of the ice body is covered with about 4 inches of foamed insulation and the foamed insulation is covered by about 24 inches of gravel and soil. The ice platform thereby constructed has (1) a central grounded ice body having a height of about 30 feet and a rectangular plan view of about 300 feet by about 150 feet, (2) an insulation jacket comprised of about 10 feet of gravel and soil around the sides of the ice body, and about 4 inches of foamed insulation and 24 inches of gravel and soil over the top of the ice body, and (3) a structural sheet pile wall surrounding the ice body and the insulation jacket, and extending about 20 feet into the marine bottom.

The peak lateral force expected at the construction site is equivalent to the force exerted by a six-feet thick sheet of ice pressing against the width of the ice platform at a pressure of about 300 p.s.i. Using known civil engineering principles, the initial stability of the ice platform thus constructed is compared to the stability of an ice platform having the same dimensions but without any structural wall, by calculating the ratio of the total force of the ice ($F_{ice}$) to the maximum static resistance force of the ice platform ($F_{SR}$). This ratio is calculated for both the end-loaded case, i.e., the peak force acts on the 150-feet width of the ice platform, and the side-loaded case. Also, the same ratios are calculated for the "aged" ice platform constructed by the method of this invention, i.e., the ice platform with structural wall after the portion of the marine bottom directly under the grounded ice body becomes frozen. These ratios are as follows:

| | Ratio ($F_{ice}/F_{SR}$) | |
|---|---|---|
| | End-Loaded | Side-Loaded |
| Ice Platform without structural wall | 0.89 | 0.45 |
| Ice Platform with structural wall, initial | 1.67 | 1.23 |
| Ice Platform with structural wall, aged | 2.10 | 1.27 |

$F_{ice}/F_{SR}$ ratios of less than 1.0 indicate that the ice platform will be displaced under the conditions disclosed. This example demonstrates the substantially increased stability which results from the use of an ice platform constructed in accordance with the method of this invention.

While particular embodiments of the invention have been described it will be understood, of course, that the invention is not limited thereto since many obvious modifications can be made, and it is intended to include within this invention any such modification as will fall within the scope of the appended claims.

Having now described the invention, I claim:

1. A method for constructing an ice platform at a cold offshore location having a sheet of ice floating on a water body overlying a marine bottom, said method comprising the steps of:

(a) accumulating ice on the top surface of a selected portion of said ice sheet to thereby form an ice mass on said preselected portion, said ice being accumulated at least until the weight of said ice mass deforms said ice sheet and said selected portion of said ice sheet thereby becomes grounded on said marine bottom to form a grounded ice body comprised of said ice mass and said selected portion;

(b) driving a first rigid wall element through the ice around the perimeter of said ice body and a preselected distance into said marine bottom; and (c) installing insulating material between said wall element and said ice body, and over the top surface of said ice body to thereby form an insulation jacket which substantially prohibits the melting of said ice body during the warmer seasons of the year.

2. The method defined in claim 1 wherein said selected portion is substantially less than the whole of said ice sheet and is surrounded by a remaining contiguous portion of said ice sheet.

3. The method defined in claim 1 wherein said preselected distance is selected in view of the weight and dimensions of said grounded ice body in order to prohibit lateral displacement of said ice platform under the peak lateral forces expected to be exerted on said ice platform at said offshore location.

4. The method defined in claim 3 wherein said preselected distance is between about 10 and about 100 feet.

5. The method defined in claim 1 wherein said insulating material is a naturally occurring earthen material.

6. The method defined in claim 1 wherein said first wall element is a substantially vertical structural wall constructed from a plurality of interlocking segments, which segments are individually driven through said ice and into said marine bottom.

7. The method defined in claim 6 wherein said first wall element comprises a sheet pile wall.

8. The method defined in claim 1 further comprising the step of, after step (b), forming a trench between said ice body and said first wall element, and wherein at least a portion of said insulating material is installed by filling said trench therewith.

9. The method defined in claim 1 further comprising the step of driving a second wall element through said ice around the perimeter of said ice body so as to form a compartment between said first and second wall elements; and wherein said compartment is filled with at least a portion of said insulating material.

10. The method defined in claim 1 wherein the plan view shape and orientation of said selected portion of said ice sheet is selected so as to reduce the effective cross-sectional area of said ice platform upon which the peak lateral force is expected to be exerted.

11. A method for constructing an ice platform at a cold offshore location having a sheet of ice floating on a water body overlying a marine bottom, said method comprising the steps of:

distributing a first quantity of water on the surface of a selected portion of said ice sheet under ambient conditions such that the water is frozen thereon to form an ice body having a central thickened portion and tapering in thickness from said central portion outwardly to the edge of said selected portion, said selected portion being substantially less than the whole of said ice sheet and being surrounded by a remaining contiguous portion of said ice sheet, and said first quantity of water being sufficient to give to said ice body a mass sufficiently large that said ice sheet is deformed downwardly and said ice body becomes grounded on said marine bottom;

driving a plurality of rigid wall elements through said ice sheet around the perimeter of said ice body and into said marine bottom to form first and second substantially vertical, spaced apart walls defining a compartment therebetween surrounding said ice body, at least said first wall extending from a point above the level of said contiguous portion of said ice sheet to a preselected distance between about 10 feet and about 100 feet into said marine bottom;

filling said compartment with an earthen insulating material;

distributing a second quantity of water on said ice body under ambient conditions such that said ice body is thickened, thereby extending the top surface of said ice body to an elevation above the level of the contiguous portion of said ice sheet; and covering the top surface of said ice body with insulating material.

12. A multiseason ice platform comprising:

(a) a central, artificially thickened ice body grounded on a marine bottom at a selected offshore location, said ice body extending from said marine bottom upwardly to a desired elevation above the normal water level of a surrounding body of water;

(b) an insulation jacket surrounding the top and sides of said ice body, said insulation jacket being adapted to substantially prohibit melting of said ice body during the warmer seasons of the year; and (c) a rigid structural wall element contacting and surrounding the perimeter of said insulation jacket, and extending a preselected distance into said marine bottom, the combined weight of said ice body and said insulation jacket being less than the weight required to alone prohibit lateral displacement under the peak lateral forces expected to occur at said offshore location, and said preselected distance being selected in view of said combined weight so as to prohibit lateral displacement of said ice platform.

13. The platform defined in claim 12 wherein said preselected distance is between about 10 and about 100 feet.

14. The platform defined in claim 12 wherein the ratio of the volume of said ice body to the volume of said insulation jacket is between about 4 and about 200.

15. The platform defined in claim 12 wherein the plan view shape and orientation of said ice platform is selected so as to reduce the effective cross-sectional area of said ice platform upon which the peak lateral force is expected to be exerted.

* * * * *

UNITED STATES PATENT AND TRADEMARK OFFICE

CERTIFICATE OF CORRECTION

PATENT NO. : 4,242,012

DATED : December 30, 1980

INVENTOR(S) : MICHAEL E. UTT

It is certified that error appears in the above-identified patent and that said Letters Patent are hereby corrected as shown below:

In column 3, line 61, after "sheet" insert --10--.

In column 6, line 6, after "is" insert --the--, and, line 7, after "bottom" insert --14--.

In column 8, line 52, change "$(F_{ice}/F_{SR})$" to read --$(F_{SR}/F_{ice})$--, and, line 59, change "$F_{ice}/F_{SR}$" to read --$F_{SR}/F_{ice}$--.

Signed and Sealed this

Fifth Day of May 1981

[SEAL]

Attest:

RENE D. TEGTMEYER

Attesting Officer

Acting Commissioner of Patents and Trademarks